US006000247A

United States Patent [19]

Takeda et al.

[11] Patent Number: 6,000,247

[45] Date of Patent: Dec. 14, 1999

[54] HOSIERY TOE PORTION AND METHOD OF MANUFACTURING THE SAME

[75] Inventors: Susumu Takeda, Fujimi; Tsutomu Harada, Nagano, both of Japan

[73] Assignee: Takeda Leg Wear, Co., Ltd., Saitama-Ken, Japan

[21] Appl. No.: 09/069,816

[22] Filed: Apr. 30, 1998

[30] Foreign Application Priority Data

May 6, 1997 [JP] Japan ..... 9-115607

[51] Int. Cl.[6] ..... A41B 11/00

[52] U.S. Cl. ..... 66/187; 2/239

[58] Field of Search ..... 66/187, 184; 2/239

[56] References Cited

U.S. PATENT DOCUMENTS

| | | | |
|---|---|---|---|
| 1,452,302 | 4/1923 | Loven | 2/239 |
| 1,798,201 | 3/1931 | Hedges | 2/239 |
| 2,663,175 | 12/1953 | Pons | 66/179 |
| 3,128,763 | 4/1964 | Langenfeld et al. | 2/239 |
| 5,211,035 | 5/1993 | Hanson | 66/51 |
| 5,802,877 | 9/1998 | Yates et al. | 2/239 |

FOREIGN PATENT DOCUMENTS

| | | |
|---|---|---|
| 58-75701 | 5/1983 | Japan . |
| 60-165405 | 11/1985 | Japan . |
| 62-141005 | 5/1987 | Japan . |
| 6418104 | 1/1989 | Japan . |
| 2136004 | 11/1990 | Japan . |
| 3018856 | 9/1995 | Japan . |
| 9078304A | 9/1995 | Japan . |

*Primary Examiner*—Andy Falik

*Attorney, Agent, or Firm*—Birch, Stewart, Kolasch & Birch, LLP

[57] ABSTRACT

A hosiery, whose shape is quite similar to that of a foot of a man and which never presses the big toe, the hosiery includes a cylindrical section; a toe section being forwardly extended from a front end of the cylindrical section, wherein a front tip point of the toe section is located on a big toe side with respect to a center line of the hosiery; and an additional section being formed in the toe section, wherein thickness of the toe section including the additional section is thicker than that of other parts of the toe section and the additional section is located on the big toe side with respect to the center line of the hosiery.

17 Claims, 6 Drawing Sheets

HOSIERY TOE PORTION AND METHOD OF MANUFACTURING THE SAME

BACKGROUND OF THE INVENTION

The present invention relates to hosiery and a method of manufacturing the hosiery, more precisely relates to hosiery, which is cylindrically knitted by a hosiery knitting machine, and a method of manufacturing the hosiery.

An ordinary sock, which is an example of hosiery, is shown in FIG. 4. The sock 10 includes: a cylindrical section 11 having an upper opening section; and a toe section 12 forwardly extended from a front end of the cylindrical section 11. The toe section 12 is also cylindrically knitted, and finally its open end is sewed to be closed. The sewed section is shown as a line 14, which exists in an upper face of the toe section 12 as shown in FIG. 4.

The sock 10 shown in FIG. 4 can be manufactured by, for example, a circular knitting machine, which includes: a needle cylinder capable of rotating; and a plurality of knitting needles arranged on an outer circumferential face of the needle cylinder, and which is capable of knitting the sock 10 by: rotary action in which the needle cylinder is continuously rotated in a prescribed direction; and pivot action in which the needle cylinder is alternately rotated in a first direction and a second direction, which is the opposite direction with respect to the first direction.

As shown in FIG. 6A, the knitting needle 50 includes: a hook section 52, which is provided to a front end of the knitting needle 50; and an open-close member 54, whose one end is pivotably connected to an axis 56 fixed to the knitting needle 50, whereby the open-close member 54 is capable of opening and closing the hook section 52. On the other hand, the needle cylinder 60 is shown in FIG. 6B. The needle cylinder 60 includes: a cylindrical member 62, and a plurality of vertical grooves 64, which are grooved on the outer circumferential face of the cylindrical member 62 in the longitudinal direction. A plurality of the knitting needles 50 shown in FIG. 6A are respectively slidably fitted in the vertical grooves 64, so each knitting needle 50 is capable of vertically moving in each vertical groove 64. When the needle cylinder 60 is rotated, the knitting needles 50 are lifted upward at a prescribed position or positions so as to knit the sock.

The steps of forming a toe section of a conventional sock, by the circular knitting machine having the needle cylinder 60 and the knitting needles 50, will be explained with reference to FIGS. 5A–5C.

First, a cylindrical section 11 having a prescribed length is knitted, by continuously rotating the needle cylinder 60 in the prescribed direction, until reaching a position A–B shown in FIG. 5C, which shows a bottom face 100*a* of the conventional sock 100. Then, a toe section 102 of the sock 100 is knitted, by continuously rotating the needle cylinder 60 in the prescribed direction, until reaching a position C–D shown in FIG. 5C. While knitting the toe son 102 between the position A–B and the position C–D, the needle cylinder 60 is pivoted in the first direction and the second direction, and a number of the knitting needles 50, which actually knit the toe section 102, is gradually reduced.

Upon reaching the position C–D shown in FIGS. 5A–5C, the toe section 102 is further knitted, by pivoting in the first direction and the second direction, until reaching the position A–B shown in FIG. 5A, which shows an upper face 100*b* of the sock 100, and the number of the knitting needles 50, which actually knit the toe section 102, is gradually increased.

Upon reaching the position A–B shown in FIG. 5A, the toe section 102 is further knitted, with prescribed number of the knitting needles 50, until forming an open end in the upper part 100*b*. Then, the open end is sewed to form the sewing line 14 (see FIG. 4).

In both side faces of the toe section 102, connecting lines A–C and B–D, which are borders between the bottom part 100*a* and the upper part 100*b*, are formed. They are formed by mutually entangling thread loops of the both faces. The connecting lines A–C and B–D coincide with ends of pivoting the needle cylinder 60 in the first and the second directions.

In the sock 100 shown in FIGS. 5A–5C, the number of increasing the knitting needles 50 and the number of reducing the knitting needles 50 are substantially same while knitting the toe section 102, so that a knitting direction is fixed and parallel to a center line XA of the sock 100. Thus, the toe section 102 of the sock 100 is symmetrically formed with respect to the center line XA as shown in FIGS. 5A–5C. The thickness of a lower part 102*a* of the toe section 102 and that of an upper part 102*b* thereof is the same as shown in FIG. 5B. With this structure, the sock 100 can cover the right foot and the left foot.

In a foot of a man, the big toe is bigger than other toes, and the shape is not symmetrical. Further, a front tip point of the foot is located close to the big toe. In the case of covering the unsymmetrical foot with the symmetrical sock 100 shown in FIGS. 5A–5C in which thickness on the big toe side is equal to that on the little toe side, cloth of the sock is extended, so that the big toe is pressed by the extended cloth. Especially, the big toes sometimes endures pain while doing sports because pressure is concentrated to the big toes. And, the little toe is also pressed by the cloth because the cloth is extended and pulled by the big toe. Furthermore, the part of the sock corresponding to the big toe is always extended and rubbed with an inner face of a shoe, so it is apt to be damaged.

Further, the sewing line 14 (see FIG. 4) is located close to a tip toe or a front end of the sock 100, so the sewing line 14 corresponds to a position between base ends of toes and front ends thereof. Upper faces of toes are always rubbed by the sewing line 14, so the user sometimes gets a blister on his or her foot. Improvement of an external appearance of the sock is also required.

SUMMARY OF THE INVENTION

An object of the present invention is to provide hosiery, whose shape is quite similar to that of a foot of a man and which never presses the big toe.

Another object of the present invention is to provide a method of manufacturing said hosiery.

The inventors of the present invention have performed extensive experimentation, and have found that force pressing the big toe can be reduced by forming an additional section, which is located close to the big toe side, in the toe section.

In the hosiery, the additional section may constitute a front end part and a side part, which is on the big toe side, of the toe section. With this structure, the force pressing the big toe can be further reduced.

In the hosiery, an edge of the additional section may appear as a V-shaped line when the additional section is seen from a view point on the big toe side. With this structure, the additional section may be formed easily.

In the hosiery, the V-shaped edge line of the additional section may be bent at a mid position so as to make the additional section broader. With this structure, area of the additional section can be broader without changing a position of the front tip point of the toe section.

In the method of manufacture of the present invention, the toe section may be knitted with shifting knitting needles, which actually knit the toe section, of the knitting machine toward the big toe side. In this method, the additional section can be formed and located close to the big toe side easily.

In another embodiment of the invention a first additional section may constitute a front end part and both side parts of the big toe section, and a second additional section may constitute a front end part and a side part, which is on the big toe section side of the rest toe section. With this structure, the force pressing the big toe can be fisher reduced.

In the hosiery, an edge of the first additional section may look a V-shaped line when the first additional section is seen from a view point on each side, and an edge of the second additional section may look a V-shaped line when the second additional section is seen from a view point on the big toe section side. With this structure, the first additional section and the second additional section can be knitted in the big toe section and the rest toe section easily.

In the method of manufacture of this embodiment, the rest toe section may be knitted with shifting the knitting needles, which actually knit the rest toe section, of the knitting machine toward the big toe section.

In the conventional sock shown in FIGS. 5A–5C, as described above, the toe section is symmetrically formed, and the thickness of the toe section on the big toe side is almost equal to that on the little toe side. When the sock covers the unsymmetrical foot whose big toe is bigger than other toes, the cloth of the toe section is pulled and extended by the big toe, so that the cloth of the sock tightly fit on the foot. Thus, the big toe is pressed toward other toes; simultaneously the little toe is also pressed toward the big toe.

On the other hand, in the present invention, the additional section is located on the big toe side with respect to the center line of the hosiery, so the front tip point of the toe section is also located on the big toe side with respect to the center line. With this structure, the shape of the hosiery is quite similar to the shape of the foot of the man, and the force pressing the big toe and the little toe, which is caused by the extended cloth of the hosiery, can be greatly reduced.

In the case of the hosiery, which has the big toe section and the rest toe section, of the present invention, the big toe section includes the first additional section, and the rest toe section includes the second additional section which is located close to the big toe section. Thus, the shape of the big toe section is quite similar to the shape of the big toe of the man, and the force pressing the big toe, which is caused by the extended cloth of the hosiery, can be greatly reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF TEE DRAWINGS

Embodiments of the present invention will now be described by way of examples and with reference to the accompanying drawings which are given by way of illustration only, and thus are not limitative of the present invention, and wherein.

DETAIL DESCRIPTION OF THE PREFERRED EMBODIMENTS

Preferred embodiments of the present invention will now be described in detail with reference to the accompanying drawings.

Figure 1A:
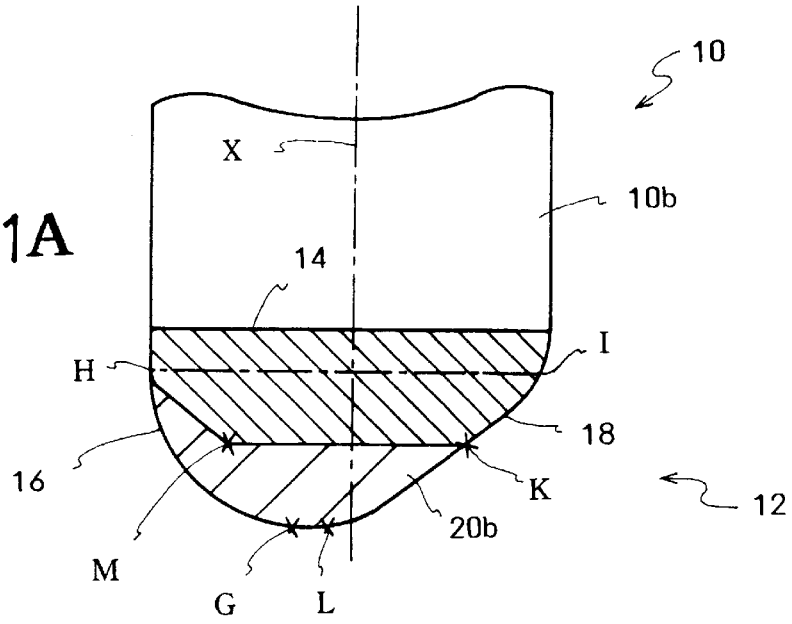
FIGS 1A–1C are various views showing a sock of an embodiment of the present invention.
Figure 1B:
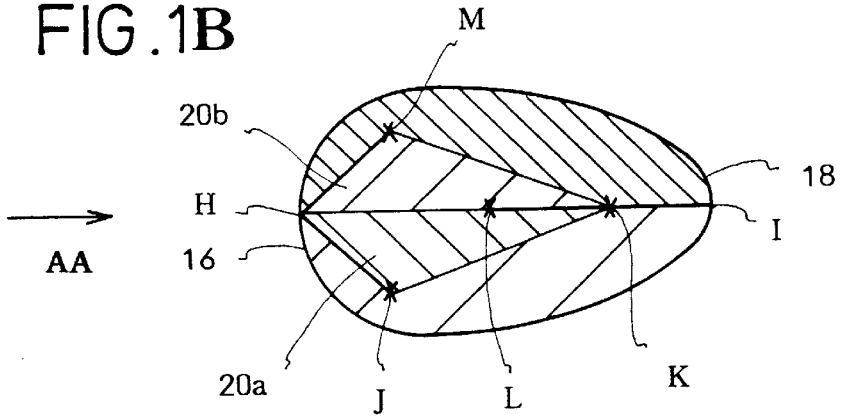
Figure 1C:
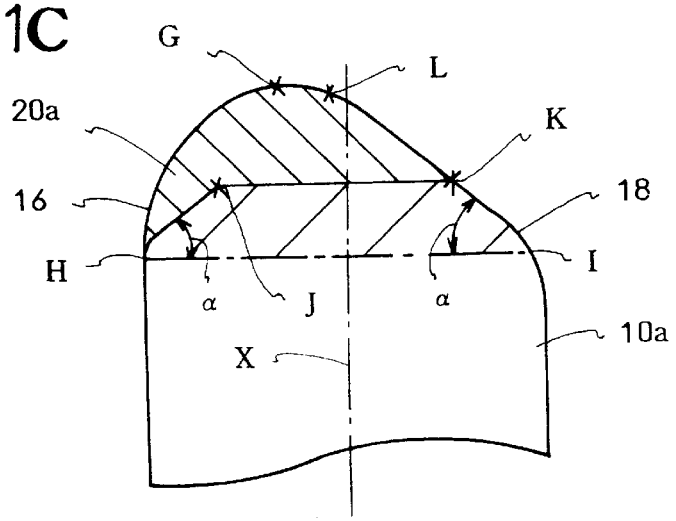
Figure 4:
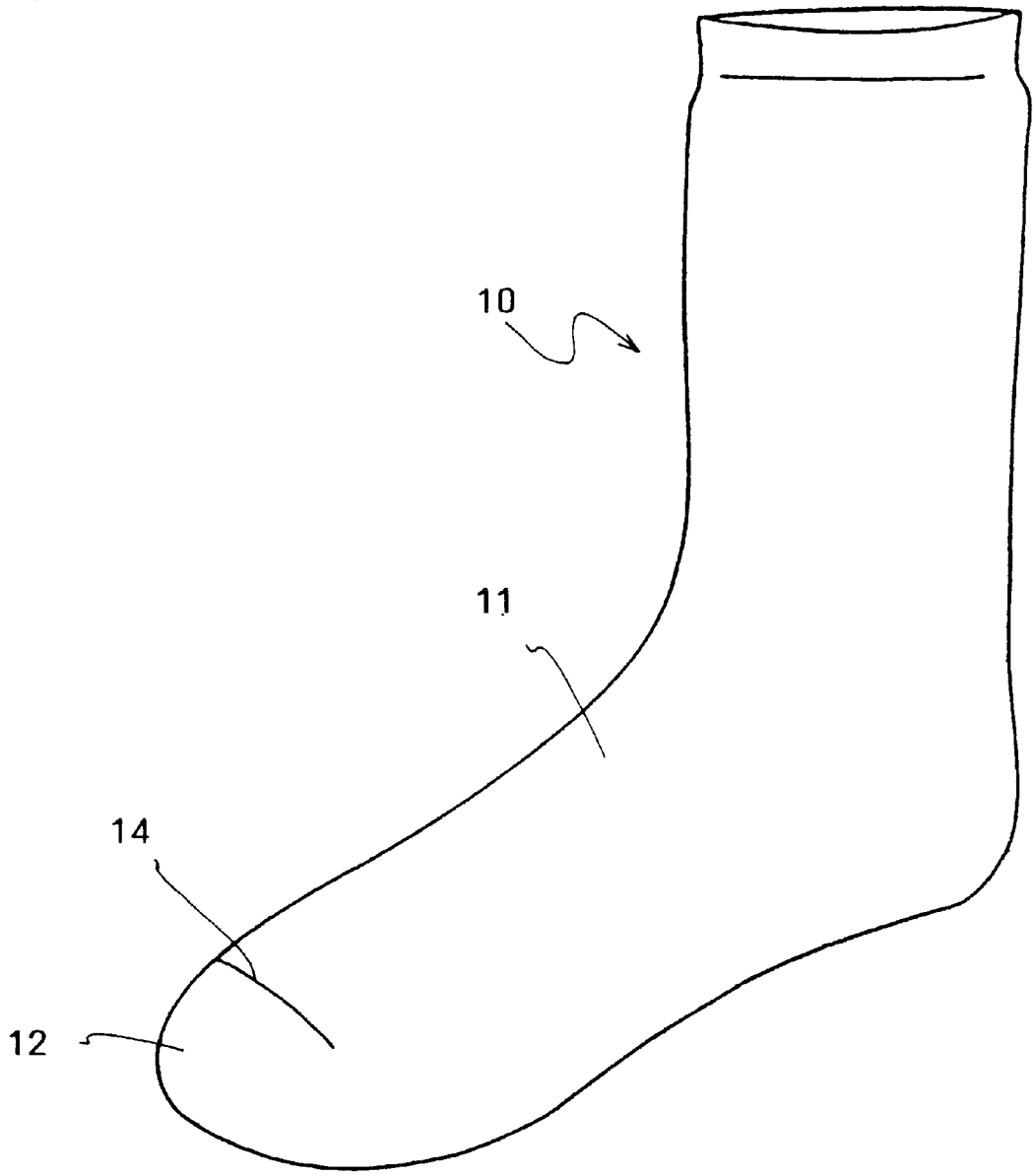
FIG. 4 PRIOR ART
FIG. 4 is a side view of the ordinary sock.

A toe section of a sock of the present embodiment is shown in FIGS. 1A–1C. The external appearance of the sock is almost the same as that of the sock 10 shown in FIG. 4 except the toe section. The toe section 12 shown in FIGS. 1A–1C is the toe section of the sock for the left foot. FIG. 1A is a plan view of an upper part 10*b* of the toe section 12; FIG. 1B is a front view of the toe section 12; and FIG. 1C is a bottom view of a bottom part 10*b* of the toe section 12.

In the toe section 12 shown in FIGS. 1A–1C, the big toe of a foot will be covered with a part corresponding to a big toe side 16, which is a left end section of the toe section 12; the little toe will be covered with a part corresponding to a little toe side 18, which is a right end section of the toe section 12.

As shown in FIGS. 1A–1C, sock 10 is unsymmetrical. The toe section 12 is forwardly extended from a lower end of the cylindrical section 11 (see FIG. 4). A front tip point G of the toe section 12 is located on the big toe side 16 with respect to a center line X of the sock 10. The shape of the sock 10 is quite similar to the shape of a man's foot.

Figure 5A:
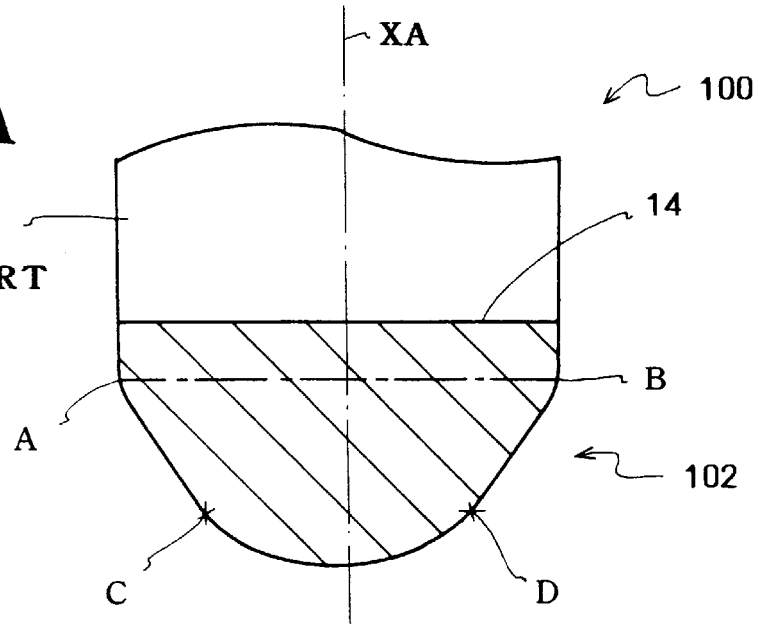
FIG. 5A PRIOR ART
FIGS. 5A–5C are various views showing the conventional sock.
Figure 5B:
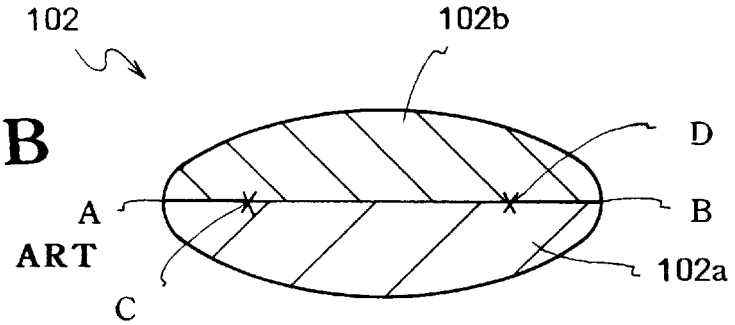
FIG. 5B PRIOR ART
Figure 5C:
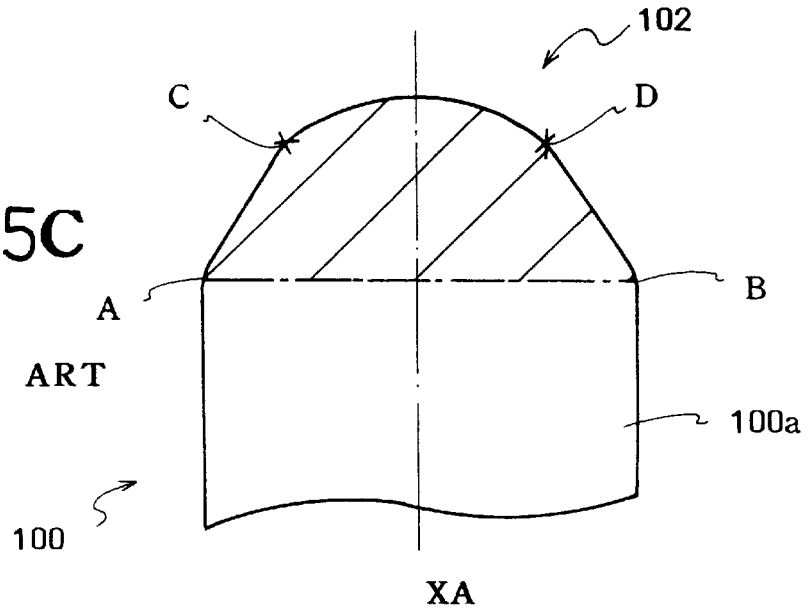
FIG. 5C PRIOR ART

Unlike the toe section 102 of the conventional sock 100 shown in FIG 5B, the toe section 12 shown in FIGS. 1A–1B has additional sections 20*a* and 20*b*, which make the toe section 12 wider. The additional sections 20*a* and 20*b* are located on the big toe side 16 with respect to the center line X. With this structures the total area of the toe section 12 on the big toe side 16 is greater than that on the little toe side 18. So the shape of the sock is quite similar to the real foot whose big toe is larger than the little toe.

When the foot is covered with the sock 10 shown in FIGS. 1A–1C, the big toe and the little toe are not pressed inwardly because the additional sections 20*a* and 20*b* constitute a front end part and a side part, which is on the big too side 16, of the toe section 12 and the big toe side 16 of the toe section 12 has a large inner space.

Edges of the additional sections 20*a* and 20*b* appear as a V-shaped line, which is formed by edge lines H–J and H–M, when the additional sections 20*a* and 20*b* are seen from a view point on the big toe side 16 in a direction AA. By forming the V-shaped edge line, the additional Lions 20*a* and 20*b* call be formed easily.

The sock 10 shown in FIGS. 1A–1C can be manufactured by knitting the toe section 12, wherein the knitting is shifted in a direction toward the big toe side 16. By shifting the knitting direction thereto, the additional sections 20*a* and 20*b* are knitted or formed on the big toe side 16 with respect to the center line X of the sock 10. And the area of the part of the toe section 12 including the additional sections 20*a* and 20*b* is greater than that of other parts thereof.

Next, a method of manufacturing the sock 10 shown in FIGS. 1A–1C by the circular knitting machine, which includes the knitting needles 50 shown in FIG. 6A and the needle cylinder 60 shown in FIG. 6B, will be explained. The needle cylinder 60 is capable of rotating; a plurality of the knitting needles 50 are circumferentially provided to the needle cylinder 60. The circular knitting machine is capable of knitting the sock 10 by: rotary action in which the needle cylinder 60 is continuously rotated in a prescribed direction; and pivot action in which the needle cylinder 60 is alternately rotated in a first direction and a second direction, which is the opposite direction with respect to the first direction.

First, the cylindrical section 11 is cylindrically knitted by continuously rotating the needle cylinder in the prescribed direction until the cylindrical section 11 has a prescribed length. Then the toe section 12 is knitted by pivoting the needle cylinder in the first direction and the second direction with increasing and reducing number of the knitting needles, which actually knit the toe section 12. Increasing and reducing the number of the knitting needles are executed when the pivoting direction of the needle cylinder is changed.

In the case of knitting the toe section 12 shown in FIGS. 1A–1C, first the toe section 12 is knitted until reaching a position H–I shown in FIG. 1C, which shows the bottom face 10*b*. Then, the toe section 12 is further knitted until reaching a position J–K with gradually reducing the number of the knitting needles which actually knit the toe section 12. In this cases the number of knitting needles reduced when the needle cylinder is pivoted in the first direction is substantially equal to the number of knitting needles reduced when the needle cylinder is pivoted in the second direction.

Upon reaching the position J–K, the toe section 12 is knitted until reaching a position H with gradually increasing the number of the knitting needles when the needle cylinder is pivoted toward the position J; simultaneously the toe section 12 is knitted until reaching a position L with gradually reducing the number of the knitting needles when the needle cylinder is pivoted toward the position K. With this action, the knitting direction can be shifted toward the big toe side 16. By shifting the knitting direction toward the big toe side 16, the additional section 20*a* can be formed in the bottom part 10*a* of the toe section 12 and located on the big toe side 16 with respect to the center line X.

Next, the toe section 12 is knitted until reaching a position M with gradually increasing the number of the knitting needles when the needle cylinder is pivoted toward the position H; simultaneously the toe section 12 is knitted until reaching a position K with gradually reducing the number of the knitting needles when the needle cylinder is pivoted toward the position L. With this action, the knitting direction can be shifted toward the big toe side 16. By shifting the knitting direction toward the big toe side 16, the additional section 20*b* can be formed in the upper part 10*b* of the toe section 12 and located on the big toe side 16 with respect to the center line X The additional sections 20*a* and 20*b* are integrated.

Upon reaching the position M–K, the toe section 12 is knitted until reaching a position H–I with increasing the number of the knitting needles. In this case, the number of knitting needles increased when the needle cylinder is pivoted in the first direction is substantially equal to the number of knitting needles increased when the needle cylinder is pivoted in the second direction.

Upon reaching the position H–I, the toe section 12 is further knitted, with a prescribed number of the knitting needles, until forming an open end in the upper part lob. Then the open end is sewed to form the sewing line 14.

In the toe section 12, connecting lines H–J, I–K, K–L and H–M are formed. They are formed by mutually entangling thread loops. The connecting lines H–J, I–K, K–L and H–M coincide with ends of pivoting the needle cylinder in the first and the second directions.

The connecting lines H–J and H–M are edges of the additional section 20*a* and 20*b* constituting the side part of the big toe side 16, and they appear as a V-shaped line when they are seen from the view point on the big toe side 16 in the direction AA.

Note that, in the present embodiment, the knitting needles increased or reduced when the needle cylinder is pivoted in the first direction is substantially equal to the knitting needles increased or reduced when the needle cylinder is pivoted in the second direction. The word "substantially" means that an error of about 10% will be allowable.

In the toe section 12 of the sock 10 shown in FIGS. 1A–1C, if the front tip point G is put aside to the big toe side 16 and the angle between the connecting lines H–J and H–M, which are the edges of the additional sections 20*a* and 20*b*, is made wider so as to make the area of the additional sections 20*a* and 20*b*, which constitute the side part of the big toe side 16, and the angle a between the connecting lines H–I and I–K and a line H–I which connects the positions H and T, is made narrower, so that width of the toe section 12, which is equal to distance between the front tip point G and the line H–I, is made narrower.

Figure 2A:
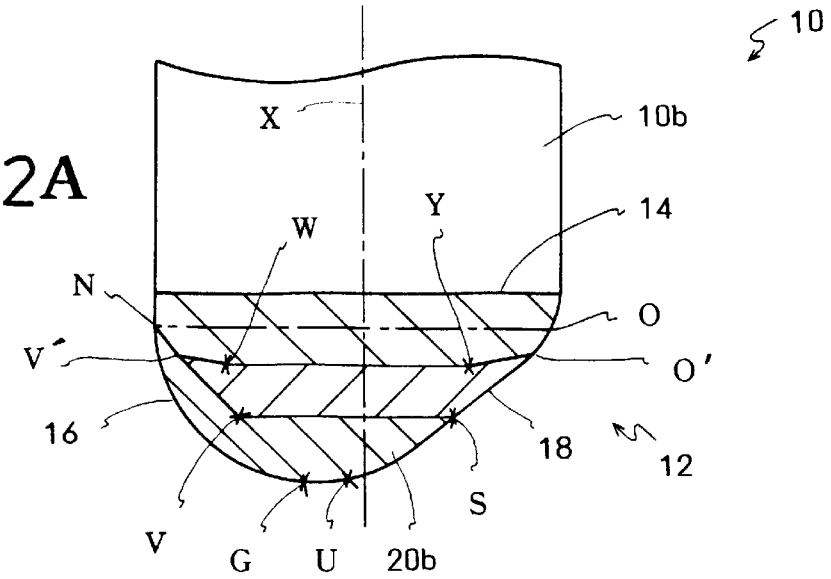
FIGS. 2A–2C are various views showing a sock of another embodiment of the present invention.
Figure 2B:
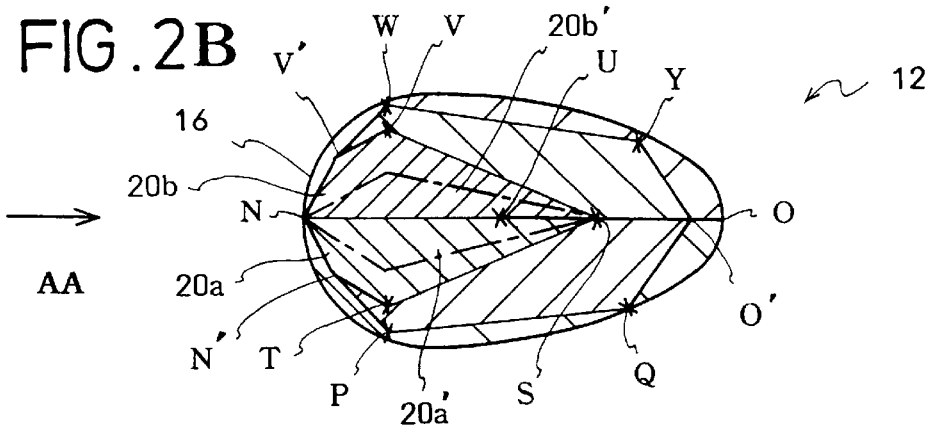
Figure 2C:
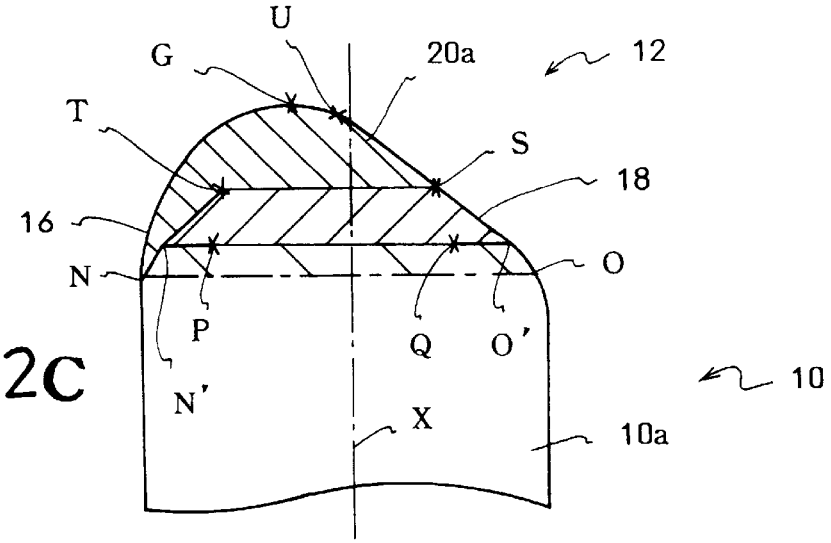

In the sock 10 shown in FIGS. 2A–2C, even if the front tip point G is put aside the big toe side 16, the area of the additional sections 20*a* and 20*b* can be made broader without making the width of the toe section 12 narrower.

FIGS. 2A–2C also show the toe section 12 of the sock 10 for the left foot. FIG. 2A is a plan view of an upper part 10b of the toe section 12; FIG. 2B is a front view of the toe section 12; and FIG. 2C is a bottom view of a bottom part 10*b* of the toe section 12.

The sock shown in FIGS. 2A–2C can be manufactured by the hosiery knitting machine. The sock shown in FIGS. 2A–2C is also knitted by the circular knitting machine, which includes the knitting needles 50 shown in FIG. 6A and the needle cylinder 60 shown in FIG. 6B.

First, the cylindrical section 11 is cylindrically knitted by continuously rotating the needle cylinder in the prescribed direction until the cylindrical section 11 has a prescribed length. Then the toe section 12 is knitted by pivoting the needle cylinder in the first direction and the second direction with increasing and reducing number of the knitting needles, which actually knit the toe section 12.

In the case of knitting the toe section 12 shown in FIGS. 2A–2C, firstly the toe section 12 is knitted until reaching a position N–0 shown in FIG. 2C, which shows the bottom face lob. Then, the toe section 12 is further knitted until reaching a position P–Q via inflection points N' and O', at which rate of reducing the number of the knitting needles is changed, with gradually reducing the number of the knitting needles. In this case, the number of knitting needles reduced when the needle cylinder is pivoted in the first direction is substantially equal to the number of knitting needles reduced when the needle cylinder is pivoted in the second direction.

Upon reaching the position P–Q, the toe section 12 is knitted until reaching the inflection points N' and O' with gradually increasing the number of the knitting needles. Then, the toe section 12 is knitted until reaching a position T–S with gradually reducing the number of the knitting needles. Between the inflection points N'–O' and the position T–S, the number of knitting needles reduced when the needle cylinder is pivoted in the first Notion is substantially equal to the number of knitting needles reduced when the needle cylinder is pivoted in the second direction But the rate of reducing the knitting needles between the inflection points N'–O' and the position T–S is less than that between the inflection points N'–O' and the position P–Q.

Upon reaching the position T–S, the toe section 12 is further knitted until reaching a position N via the inflection point N' with increasing the number of the knitting needles when the needle cylinder is pivoted toward the position T; simultaneously the toe section 12 is knitted until reaching a position U with reducing the number of the knitting needles when the needle cylinder is pivoted toward the position S. With this action, the knitting direction can be shifted toward the big toe side 16. By shifting the knitting direction toward the big toe side 16, the additional section 20*a* can be formed in the bottom part 10*a* of the toe section 12 and put aside to the big toe side 16. Note that, the rate of increasing the number of the knitting needles is changed at the inflection point N' when the needle cylinder is pivoted toward the position T.

Upon reaching the position U–V, the toe section 12 is further knitted until reaching a position V via an inflection point V' with reducing the number of the knitting needles when the needle cylinder is pivoted toward the position V; simultaneously the toe section 12 is knitted until reaching a position S with increasing the number of the knitting needles when the needle cylinder is pivoted toward the position U. With this action, the knitting direction can be shifted toward the big toe side 16. By shifting the knitting direction toward the big toe side 16, the additional section 20*b* can be formed in the upper part lob of the toe section 12 and put aside to the big toe side 16. Note that, the rate of reducing the number of the knitting needles is changed at the inflection point V' when the needle cylinder is pivoted toward the position N. The additional sections 20*a* and 20*b* are integrated.

Upon reaching the position V–S, the toe section 12 is knitted until reaching the inflection points V'–O' with gradually increasing the number of the knitting needles, and knitted until reaching a position W–Y with reducing the number of the knitting needles. Further, the toe section 12 is knitted until reaching a position N–O with increasing the number of the knitting needles. In this case, the number of knitting needles increased and reduced when the needle cylinder is pivoted in the first direction is substantially equal to the number of knitting needles increased and reduced when the needle cylinder is pivoted in the second direction between the positions V–S and N–O. But the rate of increasing and reducing the number of the knitting needles is changed at the inflection points V' and O'.

Upon reaching the position N–O, the toe section 12 is further knitted, with a prescribed number of the knitting needles, until forming an open end in the upper part 10*b*. Then the open end is sewed to form the sewing line 14.

In the toe section 12, connecting lines N–P, O–Q, N–T, O–S, S–U, V–N, W–N and Y–O are formed. They are formed by mutually entangling thread loops. The connecting lines N–P, O–Q, N–T, O–S, S–U, V–N, W–N and Y–O coincide with ends of pivoting the needle cylinder in the first and the second directions.

The connecting lines N–T and V–N are edges of the additional section 20*a* and 20*b* constituting the side part of the big toe side 16, and they appear as a V–shaped line 10 when they are seen from the view point on the big toe side 16 in the direction AA.

In the embodiment shown in FIGS. 2A–2C, the connecting lines N–T and V–N of the additional sections 20*a* and 20*b* are outwardly inflected at the inflection points N and V', so the area of the additional sections 20*a* and 20*b*, which are put aside to the big toe section 16, is broader than that of the additional sections 20*a* and 20*b* shown in is FIGS. 1A–1C, which are shown in FIG. 2B by dotted lines.

By wearing the sock 10 shown in FIGS. 2A–2C, the force pressing the big toe can be further reduced.

Note that, in the embodiment shown in FIGS. 2A–2C, the number knitting needles increased or reduced when the needle cylinder is pivoted in the first direction is 20 substantially equal to the number of knitting needles increased or reduced when the needle cylinder is pivoted in the second direction. The word "substantially" means that an error of about 10% will be allowable.

Successively, a Japanese digitated sock, which has a big toe section, with which the big toe is covered, and a rest toe section, with which the rest toes are covered, will be explained. The present invention can be employed to the Japanese digitated socks.

Figure 3A:
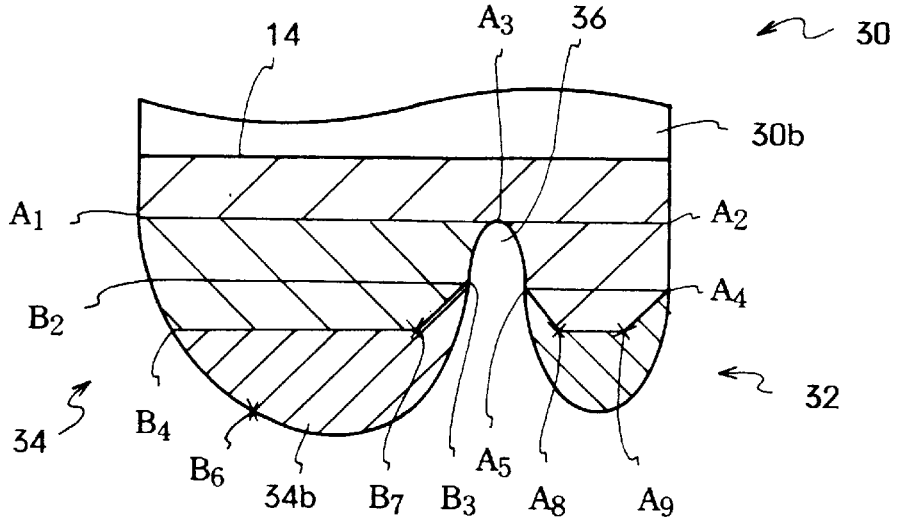
FIGS. 3A–3C are various views showing a Japanese digitated sock of another embodiment of the present invention.
Figure 3B:
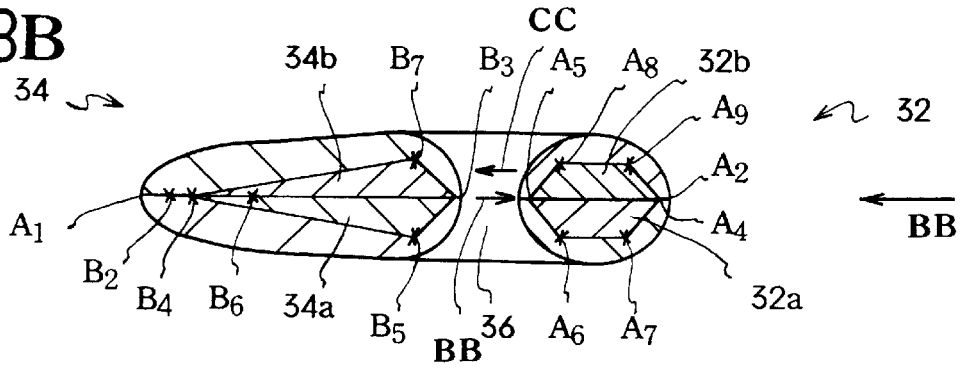
Figure 3C:
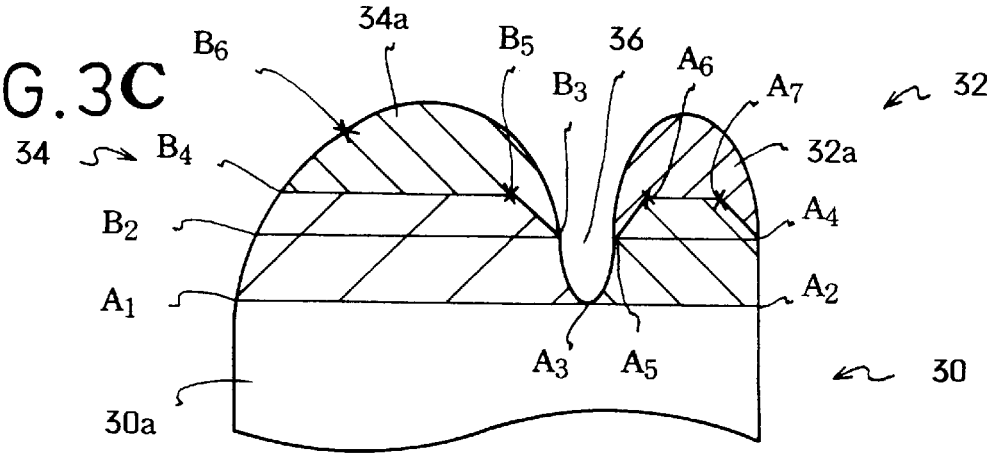

The Japanese digitated sock 30 is shown in FIGS. 3A–3C. FIGS. 3A–3C show a toe section of the sock 30 for the right foot. FIG. 3A is a plan view of an upper part 30*b* of the toe section; FIG. 3B is a front view of the toe section; and FIG. 3C is a bottom view of a bottom part 30*b* of the toe section.

Figure 6A:
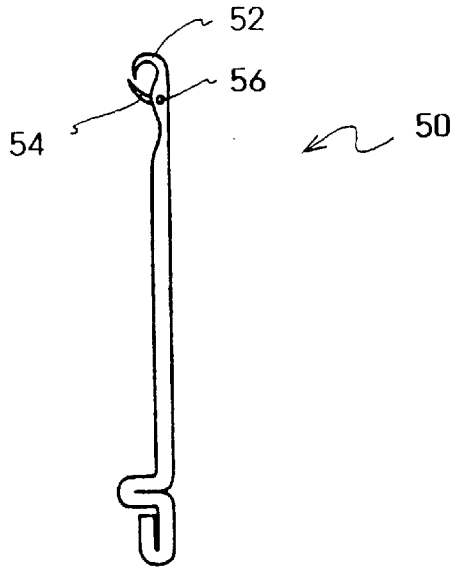
FIG. 6A is a front view of the knitting needle, which is attached to the circular knitting machine.
Figure 6B:
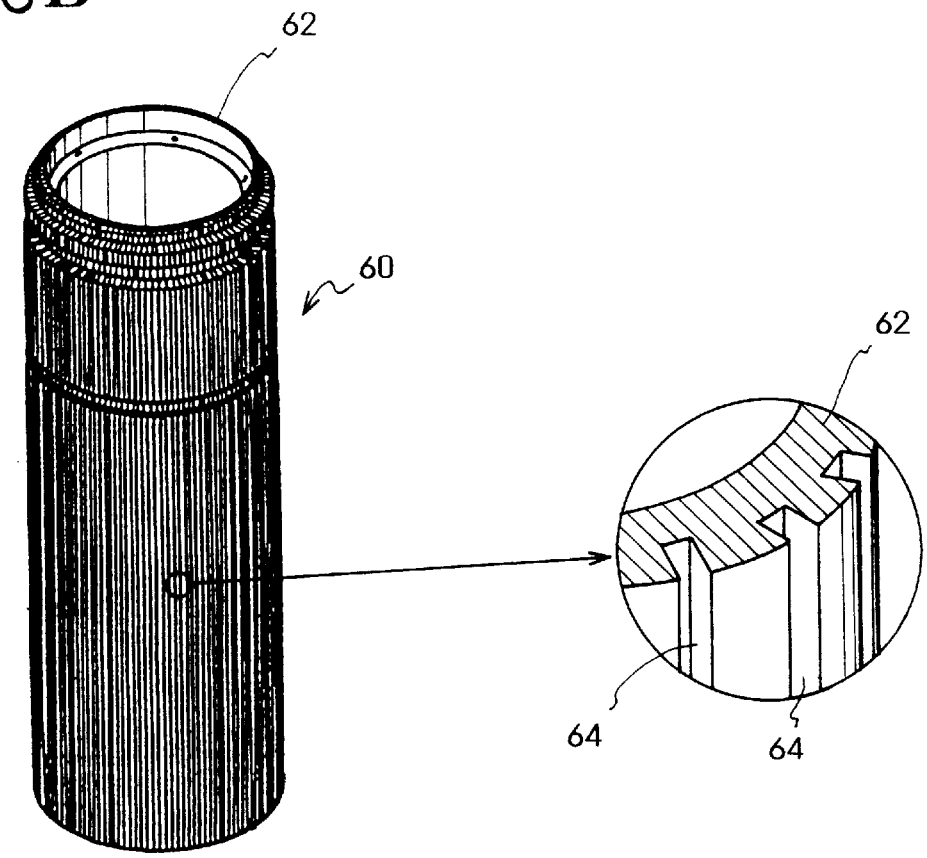
FIG. 6B is a perspective view of the needle cylinder with a partial enlarged view.

The sock 30 can be knitted by the circular knitting machine, which includes the knitting needles 50 shown in FIG. 6A and the needle cylinder 60 shown in FIG. 6B.

In the sock 30 shown in FIGS. 3A–3C, the toe section is divided into the big toe section 32 and the rest toe section 34. A clearance part 36 is formed between the toe sections 32 and 34. First additional sections 32*a* and 32*b* are knitted in the big toe section 32 so as to make the big toe section 32 thicker; second additional sections 34*a* and 34*b* are knitted in the rest toe section 34 so as to make the rest toe section 34 thicker. The additional sections 34*a* and 34*b* are put aside to the clearance part 36.

With this structure, the big toe section 32 and the rest toe section 34 of the sock 30 can be formed like a real foot, so that the pressing force of the sock 30, which presses the toes, can be reduced.

In the sock 30 shown in FIGS. 3A–3C, the first additional sections 32*a* and 32*b* constitute a front end part and both side parts of the big toe section 32; the second additional sections 34*a* and 34*b* constitute a front end part and a side part, which is on the clearance part 36 side, of the rest toe section 34. With this structure, the force pressing the toes can be further reduced Edges of the first additional sections 32*a* and 32*b* appear as a V-shaped line when the first additional sections 32*a* and 32*b* are seen, in the directions BB, from a view point on each side; edges of the second additional sections 34*a* and 34*b* appear as a V-shaped line when the second additional sections 34*a* and 34*b* are seen, in the direction CC, from a view point on the clearance part 36 side. The sock 30 can be knitted by the circular knitting machine.

The sock 30 shown in FIGS. 3A–3C can be manufactured by the hosiery knitting machine. The sock 30 shown in FIGS. 3A–3C is knitted by the circular knitting machine as well.

First, the cylindrical section 11 (see FIG. 4) is cylindrically knitted by continuously rotating the needle cylinder in the prescribed direction until the cylindrical section 11 has the prescribed length. Then the big toe section 32 and the rest toe section 32 are separately knitted by pivoting the needle cylinder in the first direction and the second direction with increasing and reducing number of the knitting needles.

In the present embodiment, the rest toe section 34 of the sock 30 is knitted after the big toe section 32 is knitted.

In the case of knitting the big toe section 32 shown in FIGS. 3A–3C, the cylindrical section 11 is knitted by continuously rotating the needle cylinder in the prescribed direction until reaching a position $A_1$–$A_2$ shown and FIG. 3C. Then the number of the knitting needles is reduced, and the big toe section 32 is knitted from the position $A_2$ to a position $A_3$.

The big toe section 32 is further knitted until reaching a position $A_4$–$A_5$ with pivoting the needle cylinder in the first direction and the second direction and gradually reducing the number of the knitting needles. In this case, the number of knitting needles reduced when the needle cylinder is pivoted in the first direction is substantially equal to the number of knitting needles reduced when the needle cylinder is pivoted in the second direction.

Upon reaching the position $A_4$–$A_5$, the big toe section 32 is further knitted until reaching a position $A_6$–$A_7$ with gradually reducing the number of the knitting needles. Between the position $A_4$–$A_5$ and the position $A_6$–$A_7$, the number of knitting needles reduced when the needle cylinder is pivoted in the first direction is substantially equal to the number of knitting needles reduced when the needle cylinder is pivoted in the second direction. But the rate of reducing the knitting needles between the positions $A_4$–$A_5$ and the position $A_6$–$A_7$ is greater than that between the position $A_2$–$A_3$ and the position $A_4$–$A_5$.

Upon reaching the position $A_6$–$A_7$, the big toe section 32 is further knitted until reaching the position $A_4$–$A_5$ with gradually increasing the number of the knitting needles. By this action, the first additional section 32*a* of the bottom part 30*a* can be completed. Upon reaching the position $A_4$–$A_5$, the big toe section 32 is further knitted until reaching a position $A_5$–$A_9$ with gradually reducing the number of the knitting needles. By this action, the first additional section 32*b* of the upper part 30*b* can be completed. The first additional sessions 32*a* and 32*b* are integrated.

Upon reaching the position $A_8$–$A_9$, the big toe section 32 is further knitted until reaching the position $A_4$–$A_5$ with gradually increasing the number of the knitting needles, then further knitted until reaching the position $A_3$–$A_2$ with gradually increasing the number of the knitting needles, so that the big toe section 32 is completed. Note that, while knitting between the positions $A_8$–$A_9$ and $A_2$–$A_3$, the rate of increasing the knitting needles between the positions $A_8$–$A_9$ and the position $A_4$–$A_5$ is greater than that between the position $A_4$–$A_5$ and the position $A_3$–$A_2$.

Next, the number of the knitting needles is adjusted to knit a position $A_1$–$A_3$, then the rest toe section 34 is knitted.

The rest toe section 34 is knitted until reaching a position $B_2$–$B_3$ with pivoting the needle cylinder in the first direction and the second direction and gradually reducing the number of the knitting needles, then further knitted until reaching a position $B_4$–$B_5$ with gradually reducing the number of the knitting needles. Between the position $B_2$–$B_3$ and the position $B_4$–$B_5$, the number of knitting needles reduced when the needle cylinder is pivoted in the first direction is substantially equal to the number of knitting needles reduced when the needle cylinder is pivoted in the second direction. But the rate of reducing the knitting needles between the positions $B_2$–$B_3$ and the position $B_4$–$B_5$ is greater than that between the position $A_1$–$A_3$ and the position $B_2$–$B_3$. In this case, the number of knitting needles reduced when the needle cylinder is pivoted in the first direction is substantially equal to the number of knitting needles reduced when the needle cylinder is pivoted in the second direction.

Upon reaching the position $B_4$–$B_5$, the rest toe section 34 is further knitted until reaching the position $B_3$ with increasing the number of the knitting needles when the needle cylinder is pivoted toward the position $B_5$; simultaneously the rest toe section 34 is knitted until reaching the position $B_5$ with reducing the number of the knitting needles when the needle cylinder is pivoted toward the position $B_5$. With this action, the knitting direction can be shifted toward the clearance part 36. By shifting the knitting direction toward the clearance part 36, the second additional section 34*a* of the bottom part 30*a* can be formed and put aside the clearance part 36.

Upon reaching the position $B_3$–$B_6$, the rest toe section 34 is further knitted until reaching the position $B_7$ with reducing the number of the knitting needles when the needle cylinder is pivoted toward the position B6; simultaneously the rest toe section 34 is knitted until reaching the position $B_4$ with increasing the number of the knitting needles when the needle cylinder is pivoted toward the position $B_6$. With this action, the knitting direction can be shifted toward the clearance part 36. By shifting the knitting direction toward the clearance part 36, the second additional Section 34*b* of the upper part 30*b* can be formed and put aside the clearance part 36. The second additional sections 34*a* and 34*a* are integrated.

Upon reaching the position $A_1$–$A_3$–$A_2$ of the upper part 30*b*, the toe section is further knitted, with a prescribed number of the knitting needles, until forming an open end in the upper part 30*b*. Then the open end is sewed to form the sewing line 14.

Connecting lines, which are formed by mutually entangling thread loops, are seen in the big toe section 32 and the rest toe section 34. The connecting lines coincide with is ends of pivoting the needle cylinder in the first and the second directions.

The connecting lines $A_5$–$A_6$ and $A_5$–$A_6$, the connecting lines $A_4$–$A_7$ and $A_4$–$A_9$ and the connecting lines $B_3$–$B_5$ and $B_3$—$B_7$ are edges of the first additional sections 32*a* and 32*b* and the second additional sections 34*a* and 34*b* . The connecting lines $A_5$–$A_6$ and $A_5$–$A_8$ and the connecting lines $A_4$–$A_7$ and $A_4$–$A_9$ respectively appear as a V-shaped line when they are seen, in the directions BB, from a view point on each side; the connecting lines $B_3$–$B_5$ and $B_3$–$B_7$ appear as a V-shaped line when they are seen, in the direction CC, from a view point on the clearance part 36 side.

Note that, in the embodiment shown in FIGS. 3A–3C, the number of knitting needles increased or reduced when the needle cylinder is pivoted in the first direction is substantially equal to the number of knitting needles increased or reduced when the needle cylinder is pivoted in the second direction. The word "substantially" means that an error of about 10% will be allowable.

In the present embodiment, the rest toe section 34 is knitted after the big toe section is knitted, but the rest toe section 34 may be knitted first if desired.

In the above described embodiments, the socks are knitted by the circular hosiery knitting machine but they may be knitted by a flat hosiery knitting machine.

In the above described embodiments, the sewing lines 14 are formed in the upper parts of the toe sections but they may be formed in the bottom parts thereof according to design, etc.

In the above described embodiments, socks, which are capable of covering from a tip toe to an ankle, are explained as the hosiery, but the present invention can he employed with long socks capable of covering beyond the an ankle, stockings capable of covering a thigh, socks having no heel parts, etc.

By wearing the hosiery of the present invention, the force pressing the big toe and the little toe, which is caused by the extended cloth of the hosiery, can be greatly reduced. The big toe does not experience discomfort even if pressure is concentrated to the big toe while, for example, doing sports, so the hosiery is advantageous for athletes. And the hosiery of the present invention is capable of outwardly deforming the big toe and the little toe. The part of the hosiery corresponding to the big toe is never extended and rubbed with an inner face of a shoe, so durability of the hosiery can be improved.

Since the sewing line, which is formed by sewing the open end of the toe section, is located so as to correspond to the base ends of the toes, upper faces of toes are never rubbed by the sewing line, so the user never gets a blister on his or her foot. The toe section is capable of covering the toes while also supporting the base ends of the toes. Furthermore, an external appearance of the hosiery can be improved.

The invention may be embodied in other specific forms without departing the spirit or essential characteristics thereof The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A hosiery, which is cylindrically knitted by a hosiery knitting machine, comprising:

a cylindrical section;

a toe section being forwardly extended from a front end of said cylindrical section, wherein a front tip point of said toe section is located on a big toe side with respect to a center line of said hosiery; and an additional section being formed in said toe section, wherein an area of said toe section including said additional section is greater than that of other parts of said toe section and said additional section is located on the big toe side with respect to the center line of said hosiery, wherein an edge of said additional section has the appearance of a V-shaped line, said V-shaped line of said additional section is bent at a mid position so as to make said additional section broader.

2. The hosiery according to claim 1, wherein said additional section constitutes a front end part and a side part being on the big toe side of said toe section.

3. The hosiery according to claim 1, wherein said front tip point of said toe section is the furthermost distant end from a foot entrance of said hosiery.

4. The hosiery according to claim 1, wherein said toe section is enlarged while said hosiery is worn, said enlarged toe section preventing a pressing together of adjacent toes of a foot during use of said hosiery.

5. The hosiery according to claim 1, wherein said hosiery is formed in a shape of a sack.

6. The hosiery according to claim 1, wherein said additional section is gradually increased in width toward a front end of said toe section.

7. A hosiery, which is cylindrically knitted by a hosiery knitting machine, comprising:

a cylindrical section;

a toe section being forwardly extended from a front end of said cylindrical section, said toe section being divided into a big toe section and a rest toe section;

a first additional section being formed in said big toe section, wherein an area of a tip part of said big toe section including said first additional section is greater than that of other parts thereof; and a second additional section being formed in said rest toe section and located close to said big toe section, wherein an area of a tapering tip part of said second additional section is greater than that of other parts thereof, wherein an edge of said first additional section has the appearance of a V-shaped line when seen from a point of view on each side thereof.

8. The hosiery according to claim 7, wherein said first additional section constitutes a front end part and both side parts of said big toe section; and said second additional section constitutes a front end part and a side part, which is on the big toe section side, of said rest toe section.

9. The hosiery according to claim 8, wherein an edge of said second additional section has the appearance of a V-shaped line when said second additional section is seen form a view point on said big toe section side.

10. The method of manufacturing a hosiery using a circular knitting machine including a needle cylinder being capable of rotating; and a plurality of knitting needles being circumferentially provided to said needle cylinder, wherein said circular knitting machine is capable of knitting said hosiery by rotary action in which the needle cylinder is continuously rotated in a prescribed direction and by pivot action in which the needle cylinder is alternately rotated in a first direction and a second direction, said second direction being the opposite direction with respect to the first direction, comprising the steps of:

knitting a cylindrical section;

knitting a toe section being forwardly extended from a front end of said cylindrical section;

shifting a knitting direction of said knitting machine toward a big toe side of said hosiery; and knitting an additional section of said toe section on said big toe side with respect to a center line of said hosiery, said additional section having the appearance of a V-shaped line, said V-shaped line of said additional section being bent at a mid position so as to make said additional section broader.

11. The method according to claim 10, wherein the knitting of said toe and additional sections further comprises the steps of:

pivoting in a first operation said needle cylinder in a first direction while increasing a number of knitting needles implemented from said needle cylinder;

pivoting in said first operation said needle cylinder in a second direction while reducing a number of knitting needles implemented from said needle cylinder;

pivoting in a subsequent operation said needle cylinder in a first direction while increasing a number of knitting needles implemented from said needle cylinder; and pivoting in said subsequent operation said needle cylinder in a second direction while reducing a number of knitting needles implemented from said needle cylinder.

12. The method according to claim 10, wherein the step of knitting said additional section comprises the step of:

integrating an upper part and a lower part of said additional section to form said additional section of said toe section.

13. The method according to claim 10, wherein the step of knitting said toe section comprises the steps of:

knitting along a diagonal line from a line drawn essentially orthogonal to said center line of said hosiery while gradually increasing a number of knitting needles implemented from said needle cylinder;

simultaneously knitting along a line adjoining said diagonal line;

pivoting said needle cylinder and knitting along an additional diagonal line while gradually reducing a number of knitting needles implemented from said needle cylinder; and shifting from said additional diagonal line toward the big toe side of said hosiery.

14. The method of manufacturing a hosiery using a circular knitting machine including a needle cylinder being capable of rotating; and a plurality of knitting needles being circumferentially provided to said needle cylinder, wherein said circular knitting machine is capable of knitting said hosiery by rotary action in which the needle cylinder is continuously rotated in a prescribed direction and by pivot action in which the needle cylinder is alternately rotated in a first direction and a second direction, said second direction being the opposite direction with respect to the first direction, comprising the steps of:

knitting a cylindrical section;

knitting a big toe section being forwardly extended from a front end of said cylindrical section;

knitting a first additional section of said big toe section while simultaneously adjusting the number of knitting needles implemented by said needle cylinder, wherein in an edge of said first additional section has the appearance of a V-shaped line;

knitting a rest toe section being forwardly extended from a front end of said cylindrical section and separated from said big toe section;

knitting second additional section of said rest toe section while shifting a knitting direction toward said big toe section; and increasing an area of a part of said rest toe section including said second additional section as compared to other parts thereof.

15. The method according to claim 14, wherein the knitting of said rest toe part further comprises the steps of:

pivoting in a first operation said needle cylinder in a first direction while increasing a number of knitting needles implemented from said needle cylinder;

pivoting in said first operation said needle cylinder in a second direction while reducing a number of knitting needles implemented from said needle cylinder;

pivoting in a subsequent operation said needle cylinder in a first direction while reducing a number of knitting needles implemented from said needle cylinder; and pivoting in said subsequent operation said needle cylinder in a second direction while increasing a number of knitting needles implemented from said needle cylinder.

16. The method according to claim 14, wherein the step of knitting said rest toe section comprises the step of:

shifting said knitting needles of said knitting machine toward said big toe section of said hosiery.

17. A hosiery, which is cylindrically knitted by a hosiery knitting machine, comprising:

a cylindrical section;

a toe section being forwardly extended from a front end of said cylindrical section, wherein a front tip point of said toe section is located on a big toe side with respect to a center line of said hosiery; and an additional section being formed in said toe section, wherein an area of said toe section including said additional section is greater than that of other parts of said toe section and said additional section is located on the big toe side with respect to the center line of said hosiery, wherein an edge of said additional section has the appearance of a V-shaped line when said additional section is seen from a view on the big toe side.

* * * * *